United States Patent [19]

Powell

[11] Patent Number: 4,776,141

[45] Date of Patent: Oct. 11, 1988

[54] SKYLIGHTS

[76] Inventor: J. William Powell, 8938 Bay Cove Ct., Orlando, Fla. 32819

[21] Appl. No.: 20,442

[22] Filed: Mar. 2, 1987

[51] Int. Cl.[4] ..... E04B 7/18; E04B 1/346

[52] U.S. Cl. ..... 52/200; 52/72

[58] Field of Search ..... 52/200, 72

[56] References Cited

U.S. PATENT DOCUMENTS

| | | | |
|---|---|---|---|
| 4,439,962 | 4/1984 | Jentoft et al. | 52/200 |
| 4,570,393 | 2/1986 | Minter | 52/72 |
| 4,570,394 | 2/1986 | Jentoft et al. | 52/200 |
| 4,589,238 | 5/1986 | Sampson | 52/200 |
| 4,594,821 | 6/1986 | Bechtold et al. | 52/72 |

*Primary Examiner*—J. Karl Bell

*Attorney, Agent, or Firm*—William F. Frank

[57] ABSTRACT

The present invention has a flange integrally formed with the wall which supports the glazed surfaces. The flange carries four ribs which are inclined toward the wall to form channels to carry any water which may pass through the roofing material away from the opening for the skylight unit. Further, the present invention uses wicking material to absorb any condensate on the interior of the glazed surfaces and carry the condensate out through the wall on the lower end of the unit.

8 Claims, 3 Drawing Sheets

SKYLIGHTS

FIELD OF INVENTION

The present invention is in the general field of the lighting of interior spaces. More specifically, the invention lies in the field of providing illumination to interior areas through roofs.

BACKGROUND OF THE INVENTION

Illumination of covered areas of buildings by other than interior light sources has a long history. Initially, openings were made in roofs over the areas. While the openings did provide light, and incidental ventilation, such openings also allowed the entrance of rain and snow. Early on, it was learned that the mere covering of such openings with at least a translucent material would keep rain and snow from falling through the opening. However, it was also learned that rain flowing down a roof could seep under the opening cover. To offset this, openings were built with a wall around the opening and the opening cover was placed on such a wall. While the wall around the opening did stop the flow of water directly into the opening, it was recognized that it was necessary to seal the juncture of the wall and the opening in the roof. The openings were normally made between the roof rafters or trusses so as not to lessen or weaken the supports for the roof. Generally, the wall of opening in the roof had a sealant of a mastic or metal flashing plates which underlay the final roof covering. Application of such sealants was time consuming. The mastic sealants were subject to dehydration and resultant withdrawal from contact between the opening wall and the roof. The use of flashing materials, which primarily are metal flanges, requires that the horizontal portion of the flange be secured to the basic roof surface and the vertical portion of the flashing be secured to the vertical surface of the wall. Once this sealing had been made, it then was required that the at least translucent covering of the opening be sealingly secured to the curb to prevent the influx of moisture during a heavy rainfall which could overflow the opening cover and on the opposite aspect allow the outward flow of interior heated air. Additionally in climatic areas subject to cold temperature, the humidity within the covered space normally results in the formation of moisture on the interior surface of the opening covering even though the covering may be double glazed.

Currently, the coverings for openings in roofs to provide light are referred to as skylights. Such skylights are characterized as rectilinear boxes having a double glazed covering. Such boxes are secured by insertion between the roof rafters or trusses by conventional means as nails, screws and the like. Waterproofing is normally accomplished by the use of stepped flashing, i.e., L-shaped metal sheets secured to the skylight frame, beginning at the lower end of the skylight insertion. After such flashing is completed, the final roof covering, shingles or tiles are installed. Such sealing of the skylight unit insertion is time consuming, and due to the nature of the sealants to dry out and retract, can require constant monitoring and repairs. To remove condensation from the interior surface of the innermost glazing, it is common practice to drill small weep holes in the vertical wall of the lower end of the skylight to allow the collected condensation to flow out onto the roof surface. The presence of such weep holes also allows air flow from the interior of the building.

SUMMARY OF THE INVENTION

The present invention is an improvement to existing skylights. The present invention has a flange integrally formed with the wall supporting the glazed surfaces. The flange eliminates the need for flashing. Additionally, the flange carries four ribs which are inclined toward the wall. These ribs form channels to carry any water which may pass through the roofing material away from the opening for the skylight unit. Further, the present invention uses wicking material to absorb any interior condensation and carry the condensation out through the wall of the unit on the lower end. The present invention has double glazing which is held in place by double butyl-silicone sealing. The outward edges of the glazed area are covered by a metal frame secured to the skylight frame by cladding.

BRIEF DESCRIPTION OF THE DRAWINGS

The present invention can be seen in the attached drawings.

DETAILED DESCRIPTION OF THE INVENTION

While the drawings show rectangular skylights, it is to be understood that the skylights may be square and will have the identical features shown and to be dsecribed in the following text.

Figure 1:
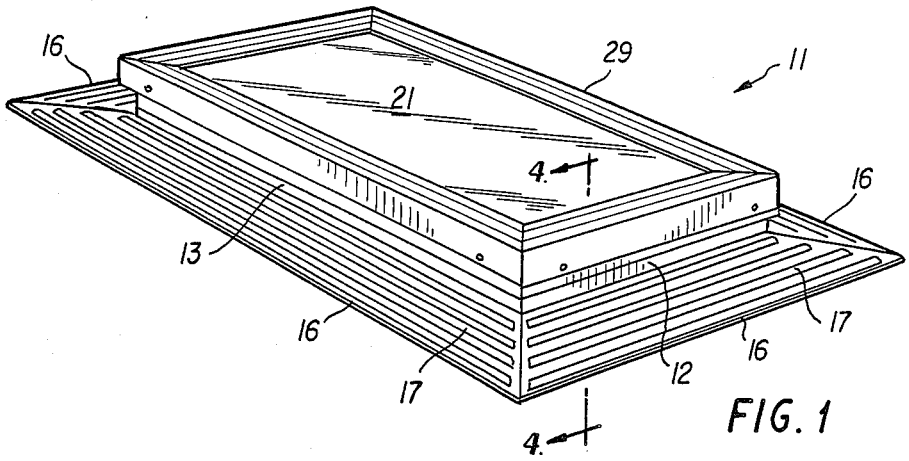
FIG. 1 is a perspective view of a first embodiment of the present invention.
Figure 4:
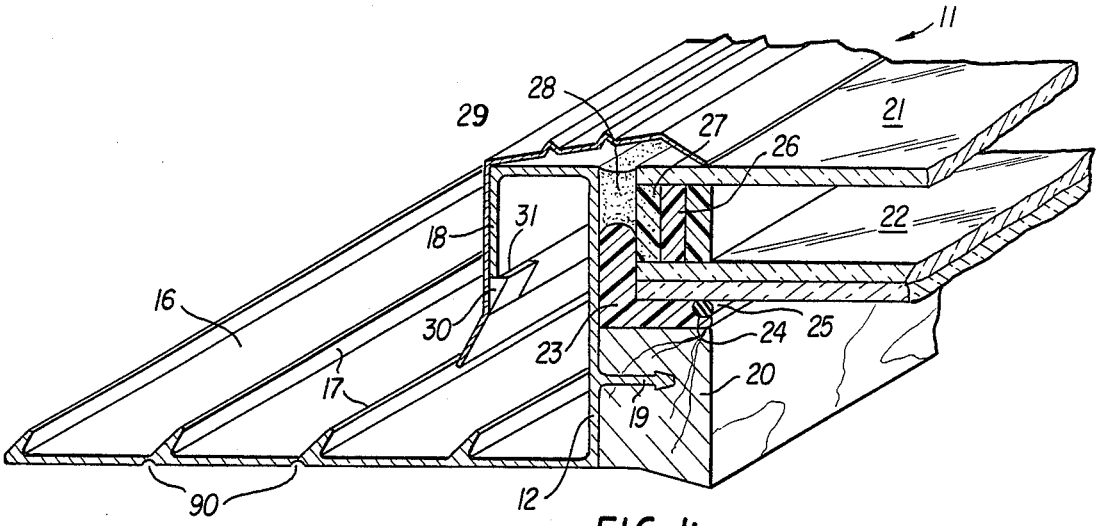
FIG. 4 is a partial cross-sectional view in perspective along plane 4—4 in FIG. 1.

FIGS. 1 and 4 show a skylight assembly 10 in which the cover portion 11 is permanently secured to a base of vertical skylight frame walls 12, 13, 14 and 15. Integrally formed with, and at the lower edges of the walls 12–15, is outwardly extending flange 16 having four rows of inwardly inclined ribs 17. The walls and flange are aluminum extruded in long strips which are cut into required lengths and then permanently secured to each other by spudding or any other well known manner used to join aluminum pieces thus producing a rigid frame. Aluminum frames are given a baked enamel finish usually of copper colored or bronze but may be of other baked enamel colors. The upper edges of walls 12–15 terminate in an integrally formed outwardly extending inverted L-shaped member 18. On the inner surface of the walls there is a continuous spline 19 to which is secured a wooden plate 20, the upper surface of which provides support for the glazing. The outward glazing 21 is of tempered glass to meet local building codes. The inboard glazing 22 may be laminated glass as shown or tempered glass, depending upon building codes. Glazing 22 rests on a continuous butyl gasket 23 of L-shape as shown. The interior edge of gasket 23 has a channel 24 formed therein for receiving wicking material 25. The wicking material 25 is only inserted in the channel 24 on the lower wall of the skylight and exist from channel 24 through an opening in the gasket 23 and the vertical wall under the protection of a cover for the glazing as seen at 90. A butyl spacing strip 26 rests on the surface of glazing 22 and a silicone gel strip 27 is pressed into the space between gasket 23 and spacer 26 to bond and seal the glazings 21 and 22, spacer 26 and gasket 23 together. An additional silicone seal 28 is pressed into place between silicone strip 27 and the upper end of the walls 12-15. The edges of the so installed glazings 21 and 22 are protected by a cover frame 29 formed from low gauge aluminum or copper by roll forming. The frame material is formed in long strips from which V-sections are cut at appropriate places and the cut strip is bent at the V-points to form the required rectilinear frame. Detents 30 are formed in the depending sides of the frame and engage the underside 31 of the L-shaped member 18. If desired, frame 29 may be additionally secured to member 18 by blind riveting.

Figure 2:
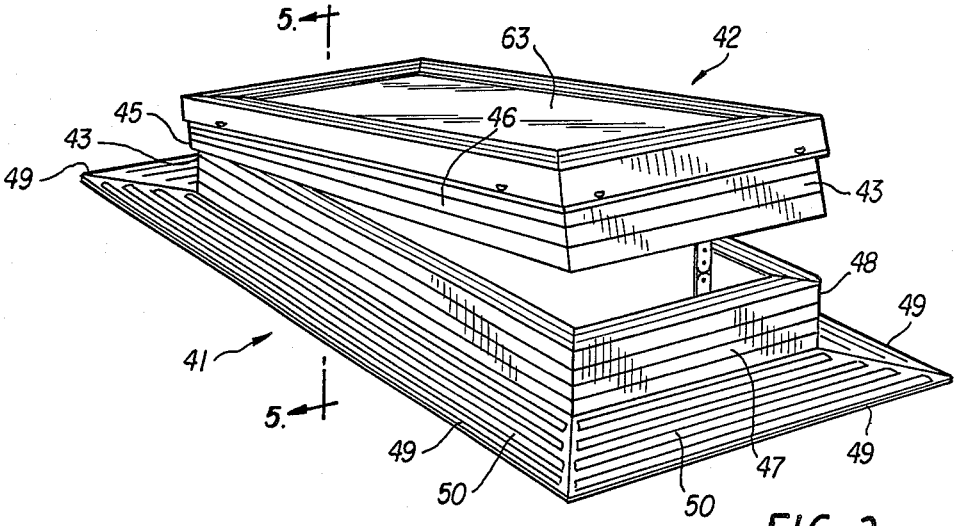
FIG. 2 is a perspective view of a second embodiment of the present invention.
Figure 5:
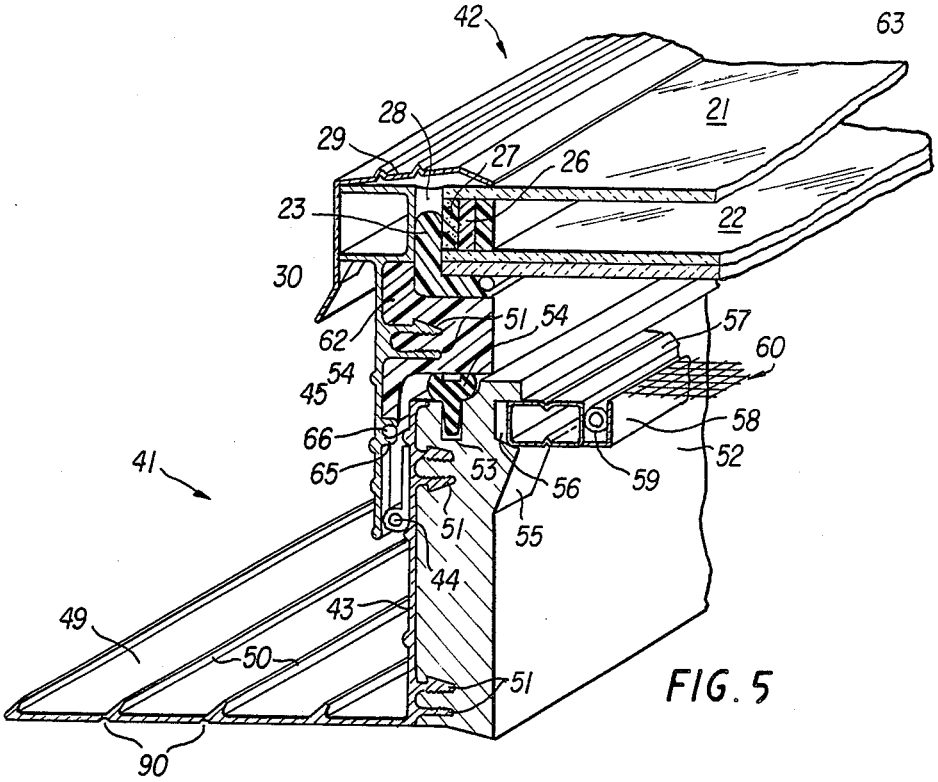
FIG. 5 is a partial cross-sectional view in perspective along plane 5—5 in FIG. 2.
Figure 6:
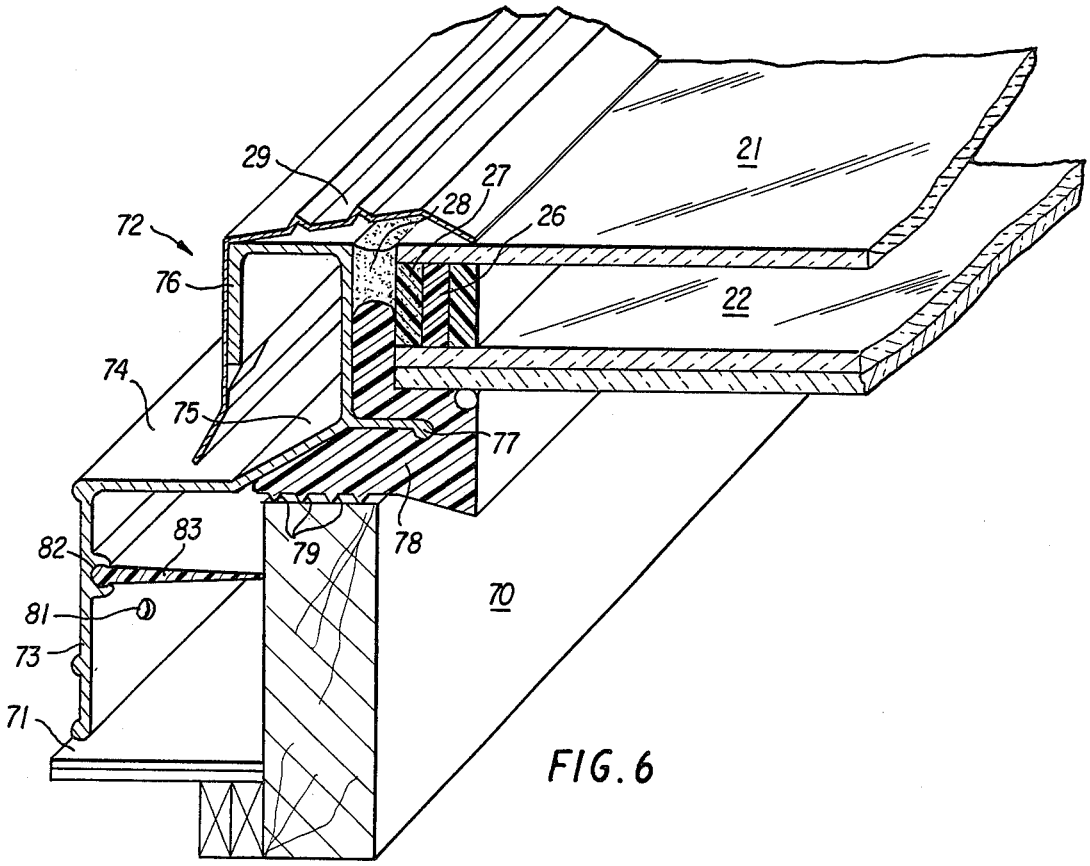
FIG. 6 is a partial cross-sectional view in perspective along plane 6—6 in FIG. 3.

Referring to FIGS. 2 and 5, there is shown a skylight assembly 40 having a base portion 41 and a cover portion 42. The cover portion 42 is pivotally attached to the wall 43 on the uppermost side of the assembly by a hinge 44 secured on one leaf to the upper portion of the depending wall 45 of the cover portion 42. The base portion 41 has walls 43, 46, 47 and 48 with integrally formed outwardly extending flange 49 with a plurality of ribs 50. The walls 43, 46–48 and flanges 49 are extended and formed into the base as described for FIGS. 1 and 4. The interior surfaces of walls 43, 46–48 each carry a plurality of splines 51 to which is secured interior wooden wall 52. A channel 53 is formed in the upper surface of wall 52 to receive and hold a resilient seal 54 upon which cover portion 42 rests when the cover portion is in the closed position. The interior upper surface of wall 52 carries continuous bracket 55 in which slot 56 is formed. Bracket 55 and slot 56 receive and support screen frame 57 which has an interior channel 58 to receive and retain molding 59 for screen wire 60. The metallic exterior surfaces of this embodiment are coated as described with reference to FIGS. 1 and 4.

The cover portion 42 in FIGS. 2 and 5 comprises walls 43, 46–48 with attendant interior splines 51 and a horizontally positioned U-section centered on, and integrally formed with, the upper ends of said walls. The interior surfaces of these walls carry splines 61 which receive and hold a horizontally positioned T-shaped wooden strip 62 which supports the glazing 63 of the ventilating cover portion 92. The glazing 63 is installed in the same manner as described for glazing 21 and 22 in FIGS. 1 and 4 and is identically composed. The bottom surface of the horizontally positioned leg of strip 62 is in sealing contact with resilient seal 54 when the cover portion is closed. Cover frame 64 is formed in the identical manner as cover frame 29 in FIGS. 1 and 4 and is held by the same cladding means. The walls of cover frame portion 42 have an additional sealing means not seen in FIGS. 1 and 4. This means comprises a channel 65 formed on the interior surface of the walls and into which is inserted a flexible wedge-shaped seal 66 the outer edge of which sealing engages the upper outer surface of the base walls 43, 46–48. The cover portion is raised at the lower end of the assembly 40 by a conventional well used and known articulated means 67. The wicking provided in FIGS. 1 and 4 is found in FIGS. 2 and 5.

Figure 3:
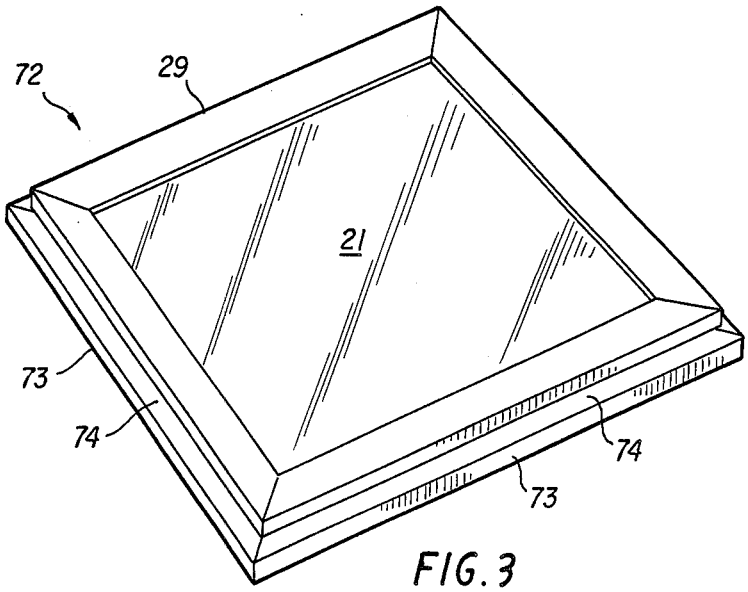
FIG. 3 is a perspective view of a third embodiment of the present invention.

The embodiment seen in FIG. 3 is structured to be fitted over what is termed a "curb mount" in the roof. This embodiment is designed to replace what can be referred to as "primitive skylights" which were built into the roof. The "curb" generally comprises walls 70 extending upwardly from the roof surface 71. The embodiment in FIG. 3 is a modified fixed skylight assembly 72. Again it is an extended aluminum form having side walls 73 depending from generally horizontally disposed flange surfaces 74 which extend over the curb walls 70. Surfaces 74 have interior surfaces 75 which are inclined upwardly to direct water outwardly over surfaces 74. Surface 75 terminate with an integrally formed inverted U-shaped member 76. At the junction of surfaces 75 and 76 there is an integrally formed spline 77. Splines 77 receive and hold the butyl gasket 78. Gasket 78 can be seen to differ considerably from gasket 23 in FIGS. 4 and 5 in that the gasket 78 extends below splice 77 and carries four sealing ribs 79 which make sealing contact with the upper surface of the walls 70. The glazing 80 in this embodiment is substantially identical to the glazing 51 and 52 seen in FIGS. 1 and 4 and is similarly installed. This embodiment has a cover frame 81 which is substantially identical to frame 29 in FIGS. 1 and 4. To secure this embodiment to the "curb," there are a plurality of holes 81 in the walls 70 through which are inserted gasket nails or screws 82. It is to be noted that this embodiment does not provide the flange protection of FIGS. 1, 2, 4 and 5, but the "curb" walls 70 are provided with adequate flashing of conventional means. The exterior surfaces of this embodiment are protected as described with reference to FIGS. 1 and 4. This embodiment has provision for the wicking arrangement of FIGS. 1 and 4.

Figure 7:
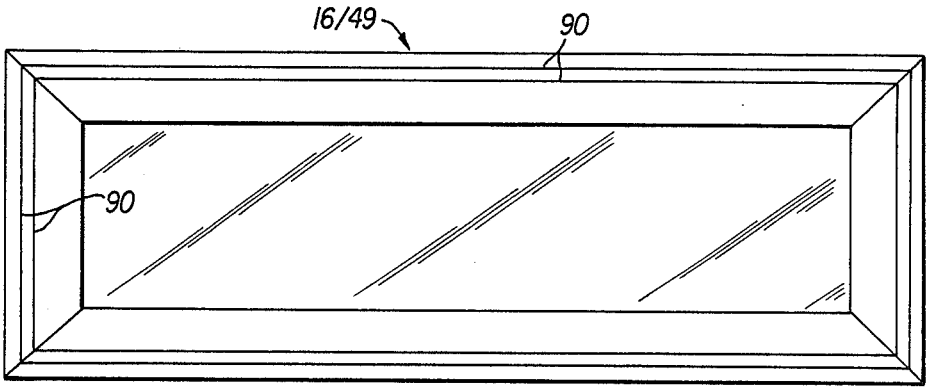
FIG. 7 is a plan view of the underside of the embodiments in FIGS. 1 and 2.
Figure 8:
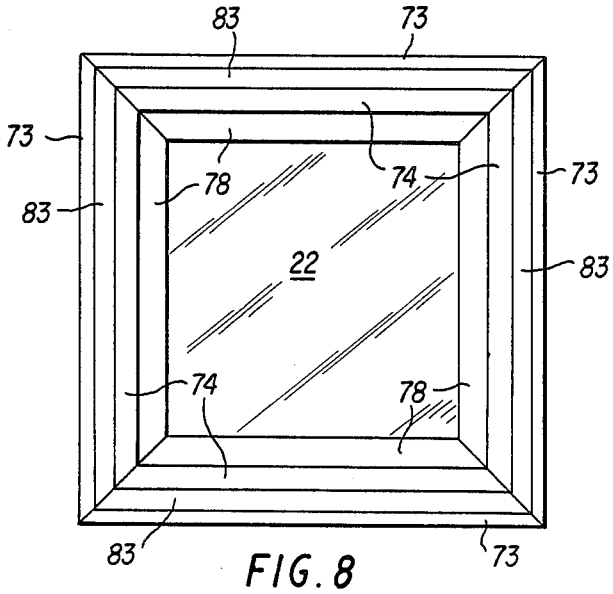
FIG. 8 is a plan view of the underside of the embodiment in FIG. 3.

With reference to FIG. 7, it should be noted that each under surface of the flanges 16 and 49 has a plurality of score chanels 90 which are just outward of ribs 17 and 50. These channels permit adjusting the width of the flanges due to roof extrusions as chimneys, ventilating pipes and the like.

While the present invention has been described as made of aluminum or copper, it is to be understood that as the advance in the plastic industry continues, substitution of plastic materials of equivalent strength and durability is encompassed within the scope of the present invention as recited in the accompanying claims. It is within the scope of this invention to provide such sealing means under said flanges to insure water tight integrity with the particular roofing surface.

What is claimed is:

1. The skylight assembly for a roof comprising: a base portion and a cover assembly; said base portion having an upwardly extending rectilinear single wall assembly with an integrally formed flange portion extending outwardly from the bottom of said wall assembly, said flange bearing a plurality of inclined surfaces to form a plurality of water directing channels, said wall assembly carrying means to secure said assembly to said roof in a sealing contact, said wall assembly having means on the inner vertical surface to support said cover assembly; the upper edges of said wall assembly terminating in an integrally formed outwardly extending inverted L-shaped member to support said cover assembly; said cover assembly comprising a cover frame and a double glazed area therewith to permit light to the building interior, the peripheral portion of said glazed area resting on the support means on said wall asembly and being doubly sealed with said peripheral portion; and wicking means to continuously transfer such condensation as may occur on the interior surface of said glazed area to the exterior of said assembly while simultaneously prevent access of exterior atmosphere to the interior of the building through said skylight assembly.

2. The skylight assembly according to claim 1 wherein said base portion and said cover portion are an integral unit.

3. The skylight assembly according to claim 1 wherein said cover portion is hingedly attached to said base portion at the upper end of said base portion and includes means at the lower end of said base portion to raise the lower end of said cover portion and includes means interconnecting the lower end of said base portion and said cover portion to elevate said lower end of said cover portion and further including a fixed screen member in the upper portion of said base portion.

4. The skylight assembly according to claim 2 wherein said cover assembly carries means to form sealing contact with one portion of said roof and said outwardly extending flange portion has a depending section carrying a flexible means to form a seal with a second portion of said roof.

5. The skylight assembly according to claim 1 wherein said water directing channels are inclined toward said wall assembly to direct water away from a roof opening which receives said skylight assembly.

6. The skylight assembly according to claim 1 wherein said support means on the inner surface of the wall assembly comprises a continuous spline perpendicular to said surface and a wooden plate secured to said spline and a continuous L-shaped gasket of resilient material, the upper interior edge of said gasket having a channel formed therein to receive said wicking material.

7. The skylight assembly according to claim 6 wherein said wicking material is installed in said channel of said gasket only on the lower wall of the installed skylight, said wicking material existing from said channel through an opening in said gasket and said wall under the protection of said cover frame.

8. The skylight assembly according to claim 1 wherein said cover frame has an inverted L-shape, the horizontal arm thereof resting on the horizontal surface of the inverted L-shaped member of said wall assembly, the vertical arm of said frame terminating in an outwardly extending inclined flange, detents being formed in said vertical arm to co-act with the underside of the depending member of said inverted L-shaped member of said wall assembly to secure said cover frame thereto.

* * * * *